United States Patent [19]

Uozumi et al.

[11] 3,942,577

[45] Mar. 9, 1976

[54] METHOD AND APPARATUS FOR CONTROLLING ELECTROMAGNETIC CASTING

[75] Inventors: Minoru Uozumi; Fumio Kawano, both of Toyota; Norio Iwama, Aichi, all of Japan

[73] Assignees: Toyota Jidosha Kogyo Kabushiki Kaisha; Kabushiki Kaisha Toyota Chuo Kenkyusho, both of Japan

[22] Filed: July 17, 1974

[21] Appl. No.: 489,158

[30] Foreign Application Priority Data

July 18, 1973 Japan ..... 48-81066

[52] U.S. Cl. ..... 164/4; 164/49; 164/155; 164/147; 222/383; 417/50

[51] Int. Cl.[2] ..... B22D 27/02

[58] Field of Search ..... 164/4, 155, 156, 49, 147; 222/DIG. 2, 76, 383; 266/38; 417/50

[56] References Cited

UNITED STATES PATENTS

| | | | |
|---|---|---|---|
| 3,706,399 | 12/1972 | Sundberg | 222/383 X |
| 3,791,437 | 2/1974 | Yamada et al. | 164/155 X |
| 3,834,587 | 9/1974 | Bengt et al. | 164/155 X |
| 3,844,453 | 10/1974 | Eickelberg | 164/155 X |

*Primary Examiner*—Ronald J. Shore
*Assistant Examiner*—John E. Roethel
*Attorney, Agent, or Firm*—Stevens, Davis, Miller & Mosher

[57] ABSTRACT

A method of controlling electromagnetic casting for carrying out the pouring of molten metal is disclosed which utilizes an electromagnetic force generated by a travelling magnetic field. The apparatus for performing the method is constructed so that a single magnet coil for generating a travelling magnetic field is employed and the input current of one phase of the three-phase alternating current to be applied to the magnet coil is subjected to phase control, whereby the electromagnetic force of the travelling magnetic field is controlled so as to automatically effect compensation for the change of the molten metal level due to the decrease of the amount of molten metal remaining to be poured.

6 Claims, 8 Drawing Figures

METHOD AND APPARATUS FOR CONTROLLING ELECTROMAGNETIC CASTING

This invention relates to an electromagnetic casting control method and apparatus; for pouring molten metal which utilize an electromagnetic force generated by a progressive or travelling magnetic field,.

In conventional electromagnetic casting methods and apparatus in which the electromagnetic force of a travelling magnetic field is utilized for pouting the metal into molds, casting times for the respective molds tend to increase as time lapses, because where the input is constant, the amount of molten metal in a pouring basin decreases with the lapse of time. The height by which the molten metal is to be drawn up, therefore, increases, with the result that the rate of flow of molten metal or the casting speed decreases. In an actual casting line, however, uniformity in the casting times for the respective molds is sought. This uniformity may be realized by correcting and controlling the input in dependence on the amount of the molten metal in the pouring basin. In order to ideally perform the correcting control of the input, the casting speed at every moment may be detected and the input may be controlled so as to always keep the casting speed at a predetermined value. At the present stage of the art, a detector for the casting flow velocity, especially one suitable for high temperature molten metal, has not yet been obtained and put into practical use. From the practical viewpoint, however, it is not necessary to strictly control the flow velocity of the molten metal, but it is satisfactory to make the casting times of the respective pouring jobs uniform. In known electromagnetic casting method and apparatus, consideration is given to the uniform casting times for the respective molds. As a way of making the casting times for the respective molds even, a magnet coil has been used that is divided into two coils, one of which is used for the compensation for the change of the drawing-up height on the pouring basin side and the other of which is used for the pouring of the molten metal. This structure, however, is complicated, and in addition a molten metal detecting means for compensation of the change of the drawing-up height resulting from the decrease of the amount of molten metal must be provided at the coil portion on the pouring basin side.

This invention is constructed so that a single magnet coil for generating a travelling magnetic field is employed and that the input current of one phase of the three-phase alternating current to be applied to the magnet coil is subjected to phase control, whereby the electromagnetic force of the travelling magnetic field is controlled so as to automatically effect the compensation for the change of the molten metal level due to the decrease of the amount of molten metal.

An object of this ivention is to provide an electromagnetic casting control method which utilizes one magnet coil, which makes it unnecessary to dispose any means for detecting the lowering of the molten metal level due to the decrease of the amount of molten metal in a pouring basin as in the prior art in order to compensate an input, and in which the casting times of respective pouring jobs which vary in dependence on drawing-up heights are automatically compensated, so that uniform casting times are obtained irrespective of the decrease of the amount of molten metal.

Another object of this invention is to provide an electromagnetic casting control apparatus which makes it unnecessary to employ molten metal level detecting means for detecting the decrease of the amount of molten metal in a pouring basin, and in which a molten metal-detector is used which need only detect the presence of molten metal at a sufficient distance from the molten metal at a high temperature, so that the pouring is effected by only one magnet coil without adopting any special coil.

A further object is to make it possible to keep casting times extraordinarily uniform by electrical means, so that the reliability and maintainability of the equipment are enhanced and that the quality of castings is remarkably enhanced.

Other features and advantages of the invention will be apparent from the following description taken in connection with the accompanying drawing wherein.

Figure 1:
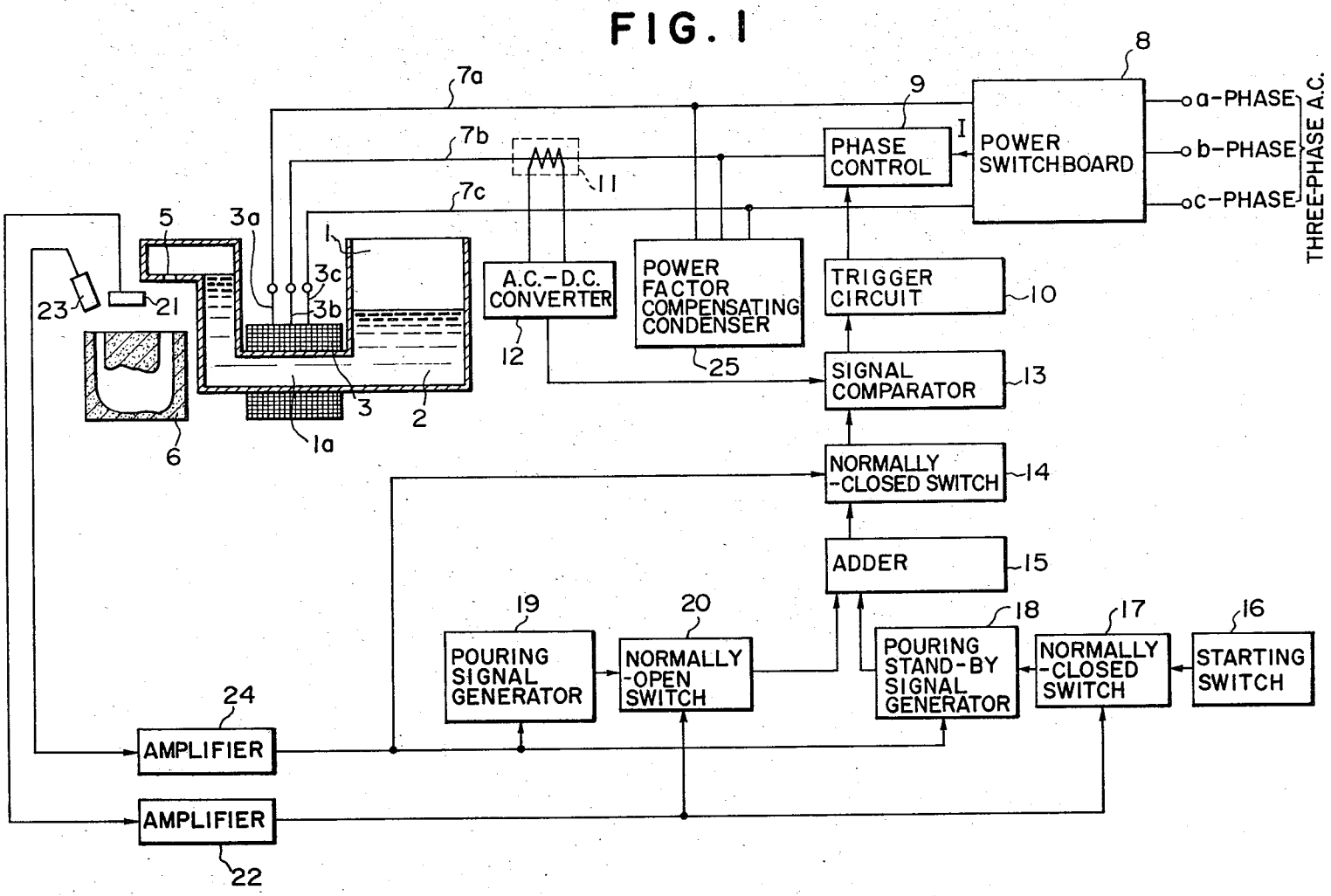
FIG. 1 is a block diagram which shows an embodiment of the electromagnetic casting apparatus according to this invention.

The block diagram of FIG. 1 illustrates an embodiment of the electromagnetic casting apparatus according to this invention utilized to perform the method according to this invention. In this figure, numeral 1 designates a pouring basin for reserving molten metal 2, which is driven by a magnet coil 3. The magnet coil 3 is disposed so as to surround communicating passage $1_a$ coupling the pouring basin 1 to a pouring hole 5,.

Figure 2:
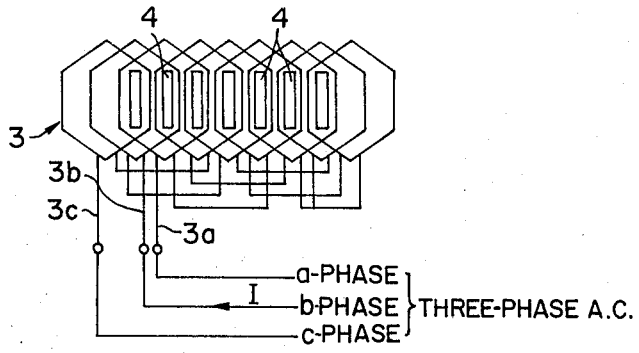
FIG. 2 shows an embodiment of a magnet coil (at 3) in FIG. 1.
Figure 5:
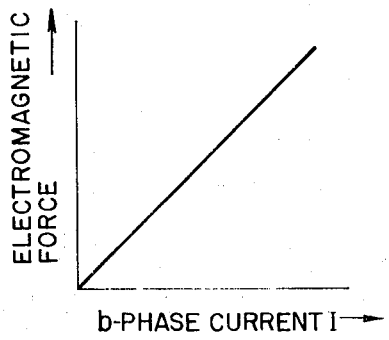
FIG. 5 is a characteristic diagram which shows the relation between a current through the magnet coil and an electromagnetic force generated therein.

An embodiment of the magnet coil 3 is shown in FIG. 2. The magnet coil 3 has three-phase alternating current applied thereto. Coils $3_a$ and $3_c$ are arranged asymmetrically to iron cores 4, while a coil $3_b$ is arranged symmetrically to an iron core 4. The magnet coil 3 thus constructed generates a progressive or travelling magnetic field as a whole. In this case, when the input current I of the coil $3_b$ wound symmetrically to the iron core 4 is varied, the magnet coil 3 generates the travelling magnetic field which has an electromagnetic force $f$ proportional to the current I of the coil $3_b$ as illustrated in FIG. 5.

Referring back to FIG. 1, a mold 6 is disposed under the pouring hole 5. Lines $7_a$, $7_b$ and $7_c$ are the feeders of the magnet coil 3. Shown at 8 is a power switchboard. Numeral 9 indicates a phase control device for adjusting an input to the electromagnetic casting equipment. It employs circuit elements such as thyristors, and regulates the input current I of the coil $3_b$ by controlling the firing angle of the elements. Numeral 10 denotes a trigger circuit for the phase control. A current transformer 11 measures the value of a current flowing through the coil $3_b$. An A. C.-to-D. C. converter 12 converts the output of the current transformer 11 into a D. C. control signal. A signal comparator 13 takes out the deviation between a control aim signal and the output signal of the converter 12. Numeral 14 represents a normally-closed switch, 15 an adder, 16 a starting switch, and 17 a normally-closed switch. Shown at 18 is a pouring stand-by signal generator, which generates a control signal uniformly increasing at a fixed rate upon actuation of the starting switch 16. A pouring signal generator 19 generates a pouring signal whose value is constant during pouring or varies in conformity with a predetermined pattern with the lapse of time. Numeral 20 designates a normally-open switch. A molten metal-detector 21 detects the molten metal by means of a phototransistor or the like. An amplifier 22 subjects the molten metal-detection signal of the detector 21 to amplification and waveform shaping. A finish detector 23 is constructed of a phototransistor or the like, and detects the completion of the pouring into the mold 6. An amplifier 24 amplifies the output signal of the finish detector 23. Numeral 25 represents a power factor compensating condenser.

Figure 6:
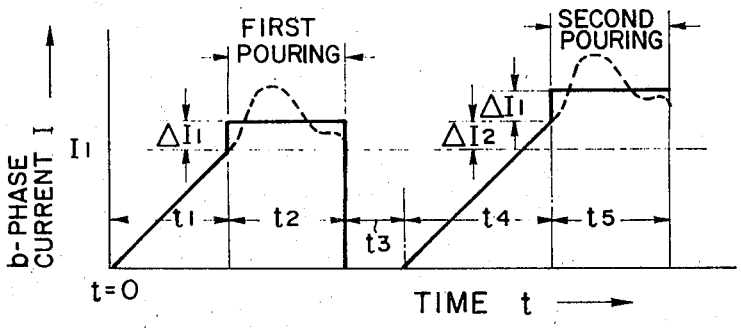
FIGS. 6 and 7 are diagrams for elucidating the operations of the apparatus.

When the starting switch 16 is actuated, the pouring stand-by signal generator 18 is started through the normally-closed switch 17. The pouring stand-by signal generator 18 is an integrating amplifier in which the input and output of an amplifier of high gain are coupled by a condenser. When a D. C. current is applied to the input stage of the integrating amplifier 18 stepwise by the starting switch, a voltage that is the integrated input is obtained at the output stage. More specifically, the integrated voltage is the control signal I, as shown in FIG. 6, which starts at $t = 0$ and increases relative to the time $t$ substantially linearly.

Figure 3:
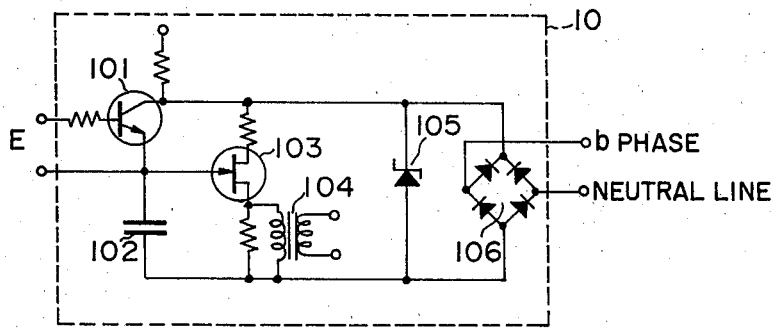
FIG. 3 shows an embodiment of a trigger circuit (at 10) in FIG. 1.
Figure 4:
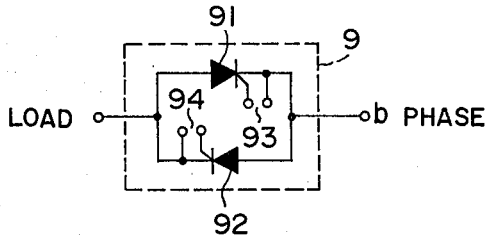
FIG. 4 shows an embodiment of a phase control device (at 9) in FIG. 1.

The control signal produced by generator 18 is applied to the input of adder 15. At this time, the pouring signal generator 19 for supplying another input of the adder 15 has not yet started, and the normally-open switch 20 is in the open state. Therefore, the pouring signal of the pouring signal generator 19 is not applied to the adder 15, and the control signal of the pouring stand-by signal generator 18 is fed through the normally-closed switch 14 to the signal comparator 13 without any change. The control signal of the pouring stand-by signal generator 18 as applied to the comparator 13 drives the trigger circuit 10, and controls the phase control device 9. As shown in FIG. 3, the trigger circuit 10 comprises a relaxation oscillation circuit, a Zener diode 105 for holding a predetermined voltage, and a rectifier 106 of the bridge type. The relaxation oscillation circuit consists of a transistor 101 as well as a condenser 102, a uninjunction transistor 103, and a pulse transformer 104. As shown in FIG. 4, the phase control device 9 is constructed in such manner that two thyristors 91 and 92 are connected in antiparallel and that the antiparallel connection is inserted into the *b*-phase. When a pulse is impressed on trigger terminals 93 and 94 in the case where a sinusoidal voltage is applied across the thyristors 91 and 92, the thyristors conduct and supply power to the load during a period from the moment of the impression of the pulse on the terminals 93, 94 until the inversion of the polarity of the voltage. In the absence of the starting signal from the trigger circuit 10, the control device 9 causes the current of the b-phase of the three-phase alternating current to be zero. When the starting signal is applied to the input of device 9, it adjusts the firing angle of the b-phase and controls the b-phase current I in conformity with the input thereto. Accordingly, when the control signal of the pouring stand-by signal generator 18 is applied to the input of trigger circuit 10, the trigger circuit controls the firing angle of the phase control device 9 by the input, and in turn, the phase control device 9 increases the current I of the b-phase in proportion to the control signal of the pouring stand-by signal generator 18 as illustrated in FIG. 6. When the current I of the b-phase increases, the magnet coil 3 generates the electromagnetic force $f$ proportional to the current I as illustrated in FIG. 5. By the travelling magnetic field thereof, the molten metal 2 in the pouring basin 1 is driven towards the tapping hole 5 located at the left upper part (as viewed in FIG. 1). Thus, the level of the molten metal on the tapping hole side begins to rise in proportion to the current I or to the control signal of the pouring stand-by signal generator 18.

At this time, a D. C. input proportional to the A. C. current I of the b-phase is fed to the signal comparator 13 by the current transformer 11 as well as the A. C.-to-D. C. converter 12. The D. C. input is for monitoring, and serves to detect whether or not the current I is increasing in proportion to the control signal of the pouring stand-by signal generator 18. If the current I deviates from the control signal, the firing angle of the phase control device 9 is controlled so as to always keep the control signal and the current I proportional.

As the control signal of the pouring stand-by signal generator 18 increases, the molten metal-level on the tapping hole side rises. After a time $t_1$, the molten metal 2 begins to flow out from the pouring hole 5, and then, the molten metal-detector 21 detects the outflow of the molten metal. The detection signal of the detector 21 is amplified by the amplifier 22, and is delivered to the normally-closed switch 17 and the normally-open switch 20.

In consequence, the normally-closed switch 17 falls into the open state, to stop the increase of the control signal of the pouring stand-by signal generator 18 and to fix the control signal at a value at that time. Accordingly, a current ($I_1$) flowing through the b-phase at this time indicates the drawing-up height at which the molten metal 2 is drawn up to the pouring hole 5. The molten metal 2 is drawn up to the position of the pouring hole 5, and the molten metal-level is maintained at this position.

On the other hand, at the same time that the normally-closed switch 17 becomes open, the normally-open switch 20 becomes closed and the pouring signal generator 19 is also started. As a result, the pouring signal produced by the signal generator 19 is applied to the input of adder 15 through the now closed switch 20. The pouring signal is a signal which has a value corresponding to the increment of the force required for pouring molten metal into the mold 6, and which includes as increase of current of $\Delta I_1$ in FIG. 6.

The pouring signal of the pouring signal generator 19 as fed to the adder 15 is added to the control signal of the pouring stand-by signal generator 18 as fixed at the specific value necessary for raising the molten metal-level to the height of the pouring hole 5. Through the normally-closed switch 14, the signal comparator 13 and the trigger circuit 10, the sum signal controls the phase control device 9 so as to increase the current I of the b-phase by $\Delta I_1$. In this way, the electromagnetic force of the travelling magnetic field generated by the magnet coil 3 is increased, and it drives the molten metal 2 pushed up to the pouring hole 5 and it initiates pouring of the metal into the mold 6.

The pouring into the mold 6 proceeds, and the mold 6 provided under the pouring hole 5 is filled up with the molten metal after a period of time of $t_2$. Then, the finish detector 23 detects the state. The detection signal is amplified by the amplifier 24, whose output is delivered to the normally-closed switch 14, the pouring signal generator 19 and the pouring stand-by signal generator 18. Thus, the normally-closed switch 14 is opened, so that the signal from the adder 14 is intercepted and that the current I of the b-phase is made zero to stop the pouring. Simultaneously therewith, the pouring signal generator 19 and the pouring stand-by signal generator 18 are reset.

The first pouring job is completed by the foregoing operation.

Subsequently, the next mold 6 is arranged under the pouring hole 5 in a period of time of $t_3$ in FIG. 6, and the second pouring job is initiated. The circuit operation at the second job is quite the same as stated above. In case of the second pouring, however, the amount of the molten metal 2 in the pouring basin 1 has been reduced by the first pouring. Consequently, the drawing-up height to the pouring hole 5 increases in correspondence with the reduced component. The current I of the *b*-phase for drawing up the molten metal 2 to the level of the pouring hole 5 is greater by $\Delta I_2$ than the current $I_1$ which corresponds to the drawing-up height of the first job. The increment $\Delta I_2$ is automatically compensated by the control signal generated by the pouring stand-by signal generator 18, so that the molten metal-level is maintained at the position of the pouring hole 5. For this reason, the casting time $t_5$ of the pouring into the mold 6 due to the current increment $\Delta I_1$ for the second pouring as given by the pouring signal generator 19 is equal to the casting time $t_2$ of the first job.

As described above, even at the second and further pouring jobs, the pouring stand-by signal generator 18 always compensates for the decreased components automatically by the control signals for changes in the drawing-up height due to the decrease of the amount of the molten metal in the pouring basin, and the molten metal-level is pushed up to the position of the pouring hole 5. Therefore, the casting time is not affected by the decrease of the amount of the molten metal at all, and the casting times at the respective pouring jobs are always constant.

Figure 7:
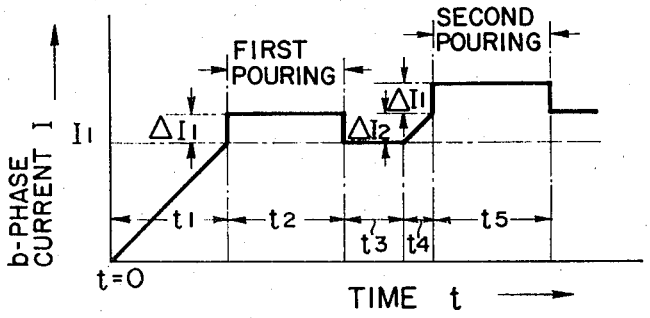

Although, in the above explanation of the operation, the pouring signal of the pouring signal generator 19 has been described as having a fixed value, the quality of a product can also be remarkably enhanced by the use of a pouring signal which, as shown by way of example as dotted lines in FIG. 6, has the optimum pattern for the mold 6 to-be-employed. Furthermore, if the connections between the amplifier 24 and the pouring stand-by signal generator 18 and between the amplifier 24 and the normally-closed switch 14 are separated in FIG. 1, the control signal of the pouring stand-by signal generator 18 is maintained at the value of the drawing-up height at the preceding pouring job. In consequence, the drawing-up time $t_4$ at the succeeding pouring job can be shortened as illustrated in FIG. 7. In addition, the control signal of the pouring stand-by signal generator 18 is not restricted to a linearly increasing signal, it may be any signal uniformly increasing at a speed which permits the molten metal to follow up.

Figure 8:
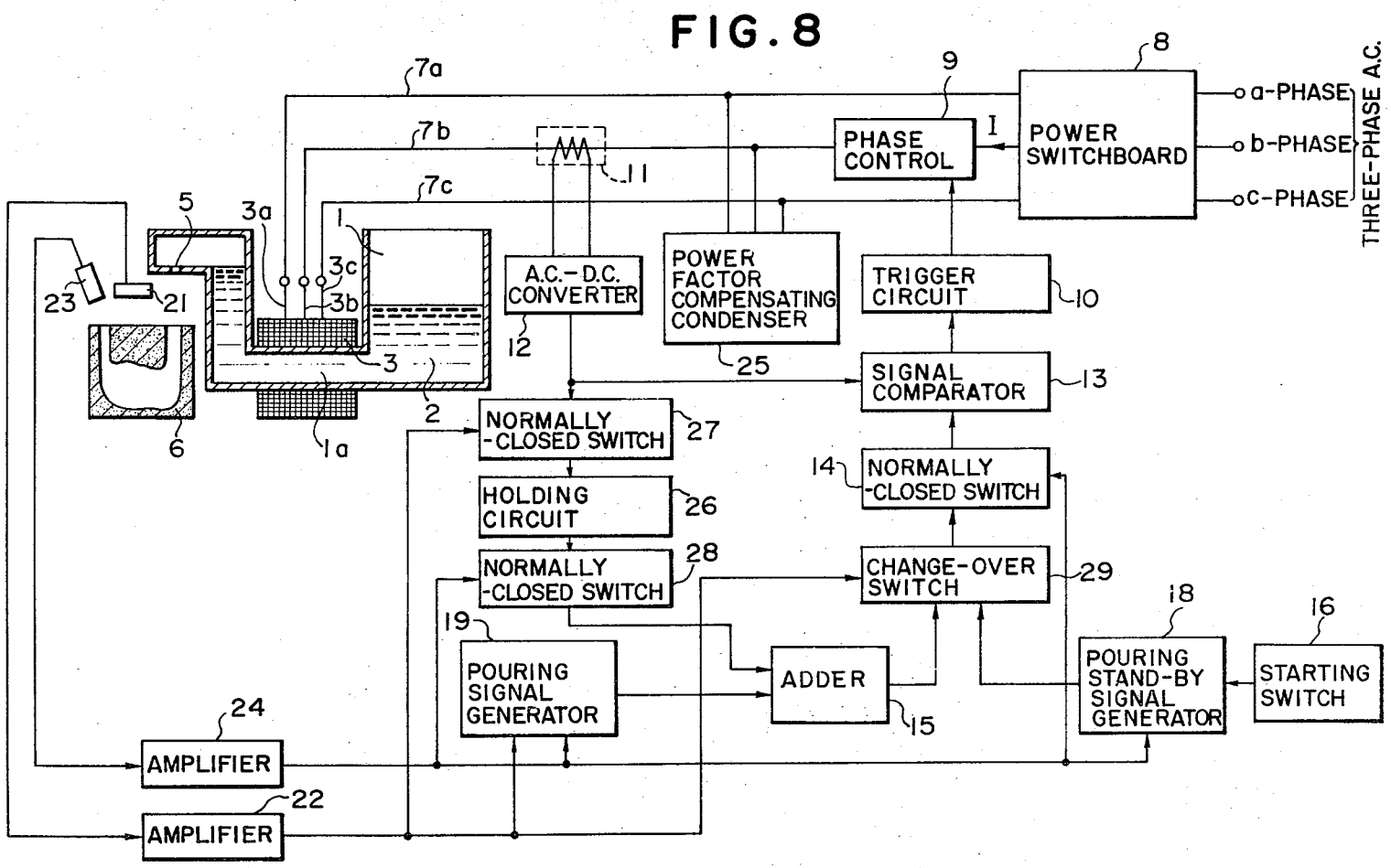
FIG. 8 is a block diagram which shows another embodiment of the electromagnetic casting apparatus according to this invention.

FIG. 8 shows another embodiment of the electromagnetic casting equipment according to this invention. In the figure, the same symbols as in FIG. 1 denote the same devices or units. Shown at 26 is a holding circuit which serves to hold the b-phase current value detected by means of the current transformer 11 and the A. C.-to-D. C. converter 12. Numerals 27 and 28 designate normally-closed switches, and numeral 29 indicates a change-over switch. Although the circuit operation is substantially the same as in FIG. 1, the following is to be noted. Until the molten metal-detector 21 detects the outflow of the molten metal, the control signal of the pouring stand-by signal generator 18 fed to the phase control device 9 through the change-over switch 29. Upon the actuation of the molten metal-detector 21, the normally-closed switch 27 is opened, the holding circuit 26 holds the D. C. current value corresponding to the b-phase current at this time, and the current value is delivered to the adder 15 through the normally-closed switch 28. Simultaneously therewith, the change-over switch 29 changes-over onto the side of the adder 15. Consequently, the control signal for drawing up the molten metal-level is thereafter fed from the holding circuit 26 to the adder 15. It is added to the pouring signal of the pouring signal generator 19 in the adder 15. The sum signal is fed to the phase control device 9, to effect the pouring into the mold 6.

What is claimed is:

1. A method of casting molten metal from a pouring basin having a pouring hole into molds wherein the casting times for the molds is held constant, said method utilizing the travelling magnetic field of a magnet coil energized by three-phase current, and which has a winding symmetric to a coil iron core at one phase; and comprising the steps of:

uniformly increasing the input current in said symmetric winding at a rate which the flow of said molten metal can sufficiently follow;

drawing said molten metal up to a level necessary for pouring from said hole by an electromagnetic force of said travelling magnetic field, and fixing a value of the current flowing to the symmetric winding when sad molten metal reaches said level necessary for pouring from said hole;

increasing the current in said symmetric winding in conformity with a predetermined pattern from the fixed value in order to raise said molten metal and pour it from said pouring hole; and making the current of said symmetric winding zero in order to stop the pouring upon detection that said mold has been filled up with said molten metal, raising the molten metal to the pouring hole for the next casting by increasing the current in said symmetric winding from a level corresponding to said previously fixed value by a second fixed amount corresponding to the decreased level of molten metal due to the first pouring and increasing the amount in said symmetric winding above said second fixed amount in accordance with a predetermined pattern to pour metal from said pouring hole for said next casting.

2. A method of casting molten metal from a pouring basin having a pouring hole into molds wherein the casting time for the molds is held constant, said method utilizing the travelling magnetic field of a magnet coil employing a three-phase current and which has a winding symmetric to a coil iron core at one phase, and comprising the steps of:

uniformly increasing the input current in said symmetric winding at a rate which the flow of said molten metal can sufficiently follow;

drawing said molten metal up to a level necessary for pouring from said pouring hole by the electromagnetic force of said travelling magnetic field, and fixing the value of the current flowing to the symmetric winding when said molten metal reaches said pouring hole for the first pouring;

increasing the current flowing to said symmetric winding in conformity with a required pattern from said fixed value in order to raise said molten metal and pour it from said pouring hole;

decreasing the current value of said symmetric winding down to said fixed value for said first pouring in order to stop said first pouring after detecting that said mold has been filled up with said molten metal;

maintaining the current of said symmetric winding at said fixed value for said first pouring while said mold is removed after completion of said pouring and a further mold for a next pouring is moved into position to receive molten metal from pouring hole;

uniformly increasing the input current of said symmetric winding for said next pouring starting at said fixed value for said first pouring;

increasing the electrical current in said symmetric winding to a second value higher than said fixed value for said first pouring by an amount corresonding to the decrease in level of molten metal due to the first pouring to raise the molten metal to said pouring hole for a second pouring, and fixing the current value for said second pouring at a level higher than said value fixed for said first pouring when said molten metal reaches said pouring hole;

increasing the current flowing to said symmetric winding for a second pouring in conformity with a predetermined pattern from the value fixed for said second pouring; and lowering the current of said symmetric winding to said fixed value for said second pouring to prepare for a subsequent pouring;

repeating the above-mentioned steps for subsequent pourings for effecting a continuous casting process.

3. An apparatus for casting molten metal from a pouring basin into molds by utilizing the travelling magnetic field of a magnet coil employing three-phase current, comprising:

a molten metal receiving chamber having a pouring hole and a horizontally extending communication passage for coupling said pouring basin, a magnet coil employing three-phase current and having an iron core, said coil being arranged in a manner to surround said communication passage for driving said molten metal, and having one winding symmetric to said iron core at one phase thereof and two windings asymmetric thereto at two other phases thereof, said coil being connected to a three-phase A.C. power source and provided with a pair of parallel-connected power factor compensating condensers, phase control means for control of the current to the symmetric winding of said magnet coil, said phase control means being connected in series between said symmetric winding and said three-phase A.C. power source, a molten metal-detector provided near said pouring hole to detect initiation of the pouring of said molten metal;

a finish detector to detect whether said mold has been filled with molten metal;

an adder connected to said phase control means for addition of a control signal and a pouring signal to produce a control;

a control circuit provided between said phase control means and said adder which controls deviation beween said control aim signal and the output signal of said phase control means;

a pouring stand-by signal generator connected to said adder, which generates, on the basis of a starting signal, said control signal uniformly increasing with time, and which maintains the control signal value at a fixed value in response to a signal from said molten metal-detector; and a pouring signal generator connected in parallel with said pouring stand-by signal generator, and connected to said adder and which generates on the basis of said signal from said molten metal-detector said pouring signal so as to effect pouring of molten metal from said basin in a predetermined pattern.

4. The apparatus according to claim 3, wherein said control circuit comprises a current transformer which measures the current value flowing through said symmetric winding, an A. C.-to-D. C. converter which converts an output of said current transformer into a D. C. control signal, and a signal comparator which takes out said deviation between said control aim signal and the signal of said output of said current transformer.

5. The apparatus according to claim 3, wherein the signal from said pouring signal generator and the signal from said pouring stand-by signal generator are applied to said adder, the output of said adder being the sum of said signals from said pouring signal generator and said pouring stand-by signal generator, the signal from said pouring signal generator being applied to said adder, upon receipt by said pouring signal generator of said signal from said molten-metal detector.

6. The apparatus according to claim 5, wherein said control circuit is adapted to feed the signal of said pouring stand-by signal generator to said phase control means through a changeover switch, and wherein said A. C.-to-D. C. converter includes a holding circuit which applies to said adder a D. C. current value corresponding to the current of said symmetric winding.

* * * * *